US006435638B1

(12) United States Patent
Wilson et al.

(10) Patent No.: US 6,435,638 B1
(45) Date of Patent: Aug. 20, 2002

(54) INK BAG FITMENT WITH AN INTEGRATED PRESSURE SENSOR FOR LOW INK DETECTION

(75) Inventors: Rhonda L. Wilson, Monmouth; Jeffrey L. Thielman, Corvallis, both of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 19 days.

(21) Appl. No.: 09/698,900

(22) Filed: Oct. 27, 2000

(51) Int. Cl.[7] ..... B41J 2/195
(52) U.S. Cl. ..... 347/7
(58) Field of Search ..... 347/7, 1, 5, 6, 347/20, 84–100; 73/706, 708, 713

(56) References Cited

U.S. PATENT DOCUMENTS

| | | | |
|---|---|---|---|
| 4,038,650 | A | 7/1977 | Evans et al. |
| 4,544,840 | A | 10/1985 | Keller |
| 4,587,535 | A | 5/1986 | Watanabe |
| 4,604,633 | A | 8/1986 | Kimura et al. |
| 4,639,738 | A | 1/1987 | Young et al. |
| 4,973,993 | A | 11/1990 | Allen |
| 4,977,413 | A | 12/1990 | Yamanaka et al. |
| 5,583,545 | A | 12/1996 | Pawlowski, Jr. et al. |
| 5,583,547 | A | 12/1996 | Gast et al. |
| 5,729,256 | A | 3/1998 | Yamanaka et al. |
| 5,992,990 | A | 11/1999 | Childers et al. |
| 6,000,773 | A | 12/1999 | Murray et al. |

FOREIGN PATENT DOCUMENTS

| | | |
|---|---|---|
| EP | 0405555 A2 | 1/1991 |
| EP | 0574182 A2 | 12/1993 |
| EP | 0840098 A2 | 5/1998 |
| EP | 0965451 A2 | 12/1999 |
| JP | 5573564 | 6/1980 |
| JP | 60024954 | 2/1985 |
| JP | 1237148 | 9/1989 |
| JP | 06064181 | 3/1994 |

OTHER PUBLICATIONS

European Search Report dated Feb. 12, 2002.

*Primary Examiner*—Raquel Yvette Gordon

(57) ABSTRACT

An ink container that includes an outer container, a collapsible ink reservoir disposed in the outer container, and a pressure transducer disposed in the pressure vessel for sensing ink level.

27 Claims, 10 Drawing Sheets

PRINTER CONTROLLER: FIRMWARE MICROPROCESSOR
80
PRINTER DRIVER
CPU
MONITOR
82B
82
82A
84
100
116
INK SUPPLY STATION
114
112
50
52
66
64
62
60
110
110A
110B
SCANNING CARRIAGE
MEDIA
40
70
AIR PRESSURE SOURCE

INK BAG FITMENT WITH AN INTEGRATED PRESSURE SENSOR FOR LOW INK DETECTION

BACKGROUND OF THE INVENTION

The disclosed invention relates to ink jet printing systems that employ replaceable consumable parts including ink cartridges, and more particularly to a replaceable ink container that includes an integrated pressure sensor that provides signals utilized to detect ink level.

The art of ink jet printing is relatively well developed. Commercial products such as computer printers, graphics plotters, and facsimile machines have been implemented with ink jet technology for producing printed media. Generally, an ink jet image is formed pursuant to precise placement on a print medium of ink drops emitted by an ink drop generating device known as an ink jet printhead. Typically, an ink jet printhead is supported on a movable carriage that traverses over the surface of the print medium and is controlled to eject drops of ink at appropriate times pursuant to command of a microcomputer or other controller, wherein the timing of the application of the ink drops is intended to correspond to a pattern of pixels of the image being printed.

Some known printers make use of an ink container that is separably replaceable from the printhead. When the ink container is exhausted it is removed and replaced with a new ink container. The use of replaceable ink containers that are separate from the printhead allow users to replace the ink container without replacing the printhead. The printhead is then replaced at or near the end of printhead life, and not when the ink container is replaced.

A consideration with ink jet printing systems that employ ink containers that are separate from the printheads is the general inability to predict an out of ink condition for an ink container. In such ink jet printing systems, it is important that printing cease when an ink container is nearly empty with a small amount of stranded ink. Otherwise, printhead damage may occur as a result of firing without ink, and/or time is wasted in operating a printer without achieving a complete printed image, which is particularly time consuming in the printing of large images which often are printed in an unattended manner on expensive media.

SUMMARY OF THE INVENTION

The invention is directed to an ink jet printing apparatus that includes an ink container and a low ink level sensing pressure transducer disposed within the ink container.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
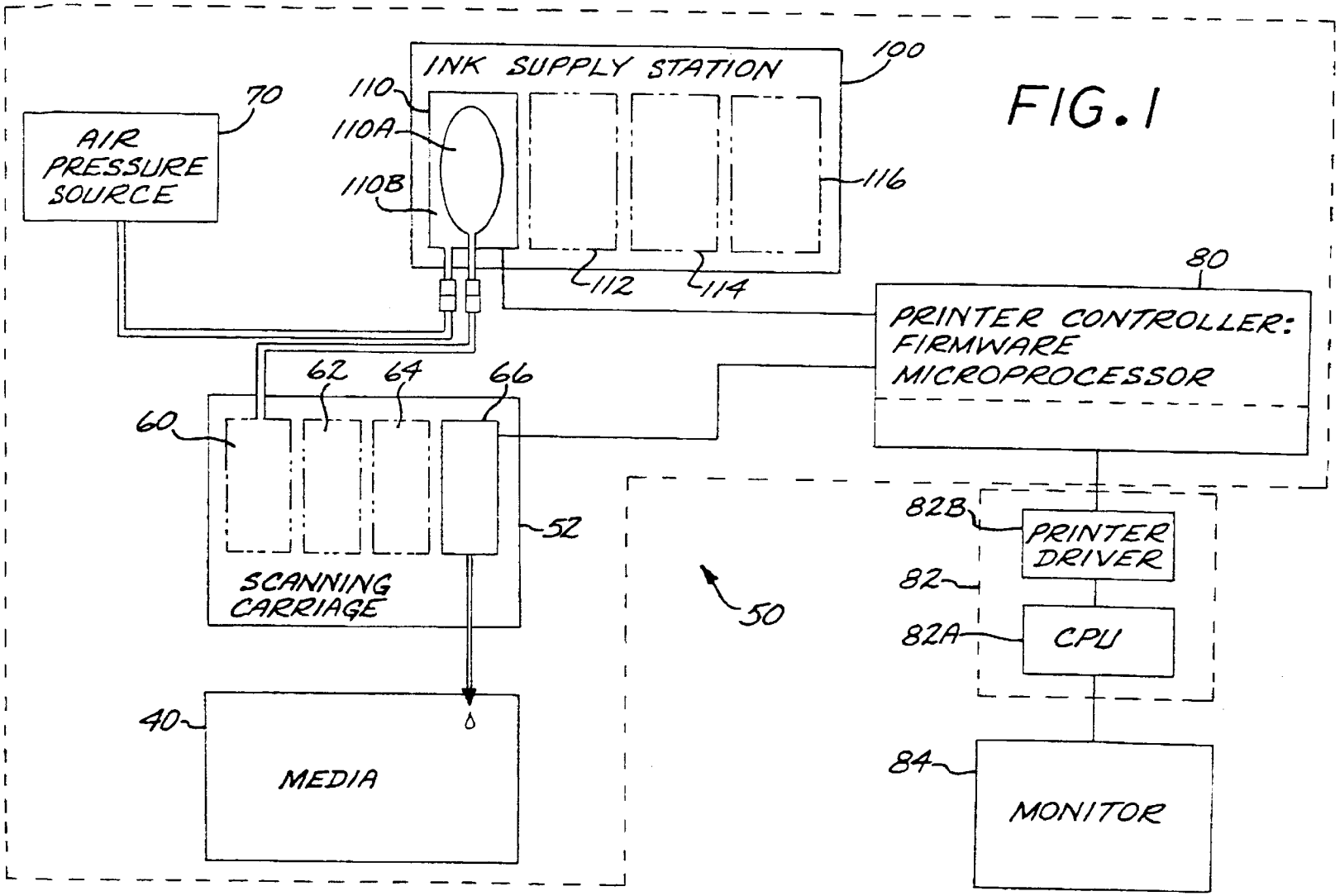
FIG. 1 is a schematic block diagram of a printer/plotter system in which an ink level sensing circuit in accordance with the invention can be employed.

In the following detailed description and in the several figures of the drawing, like elements are identified with like reference numerals.

Figure 2:
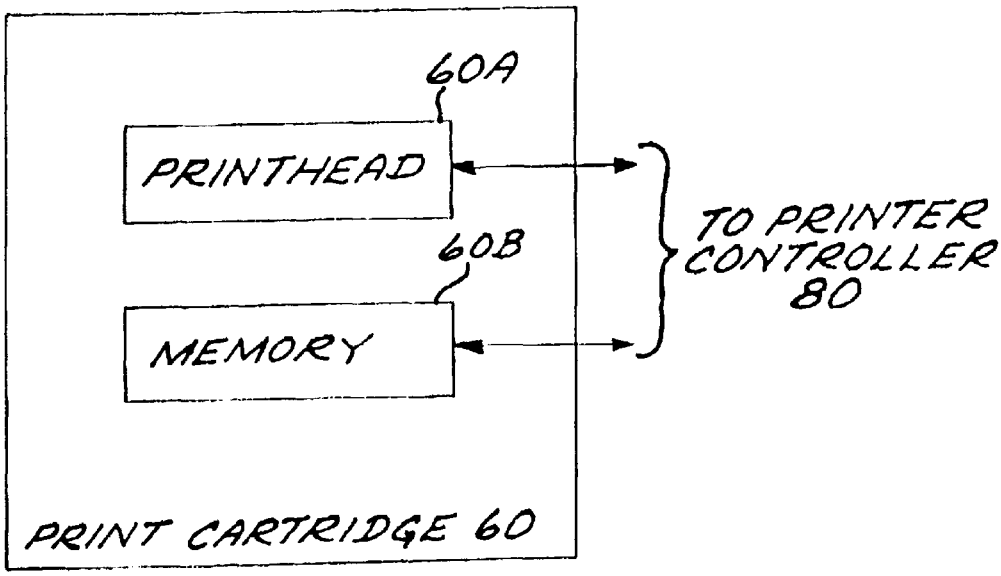
FIG. 2 is a schematic block diagram depicting major components of one of the print cartridges of the printer/plotter system of FIG. 1.

Referring now to FIG. 1, set forth therein is a schematic block diagram of a printer/plotter 50 in which the invention can be employed. A scanning print carriage 52 holds a plurality of print cartridges 60–66 which are fluidically coupled to an ink supply station 100 that supplies pressurized ink to the print cartridges 60–66. By way of illustrative example, each of the print cartridges 60–66 comprises an ink jet printhead and an integral printhead memory, as schematically depicted in FIG. 2 for the representative example of the print cartridge 60 which includes an ink jet printhead 60A and an integral printhead memory 60B. Each print cartridge has a fluidic regulator valve that opens and closes to maintain a slight negative gauge pressure in the cartridge that is optimal for printhead performance. The ink provided to each of the cartridges 60–66 is pressurized to reduce the effects of dynamic pressure drops.

The ink supply station 100 contains receptacles or bays for accepting ink containers 110–116 which are respectively associated with and fluidically connected to respective print cartridges 60–66. Each of the ink containers 110–114 includes a collapsible ink reservoir, such as collapsible ink reservoir 110A that is surrounded by an air pressure chamber 110B. An air pressure source or pump 70 is in communication with the air pressure chamber for pressurizing the collapsible ink reservoir. For example, one pressure pump supplies pressurized air for all ink containers in the system. Pressurized ink is delivered to the print cartridges by an ink flow path that includes for example respective flexible plastic tubes connected between the ink containers 110–116 and respectively associated print cartridges 60–66.

Figure 3:
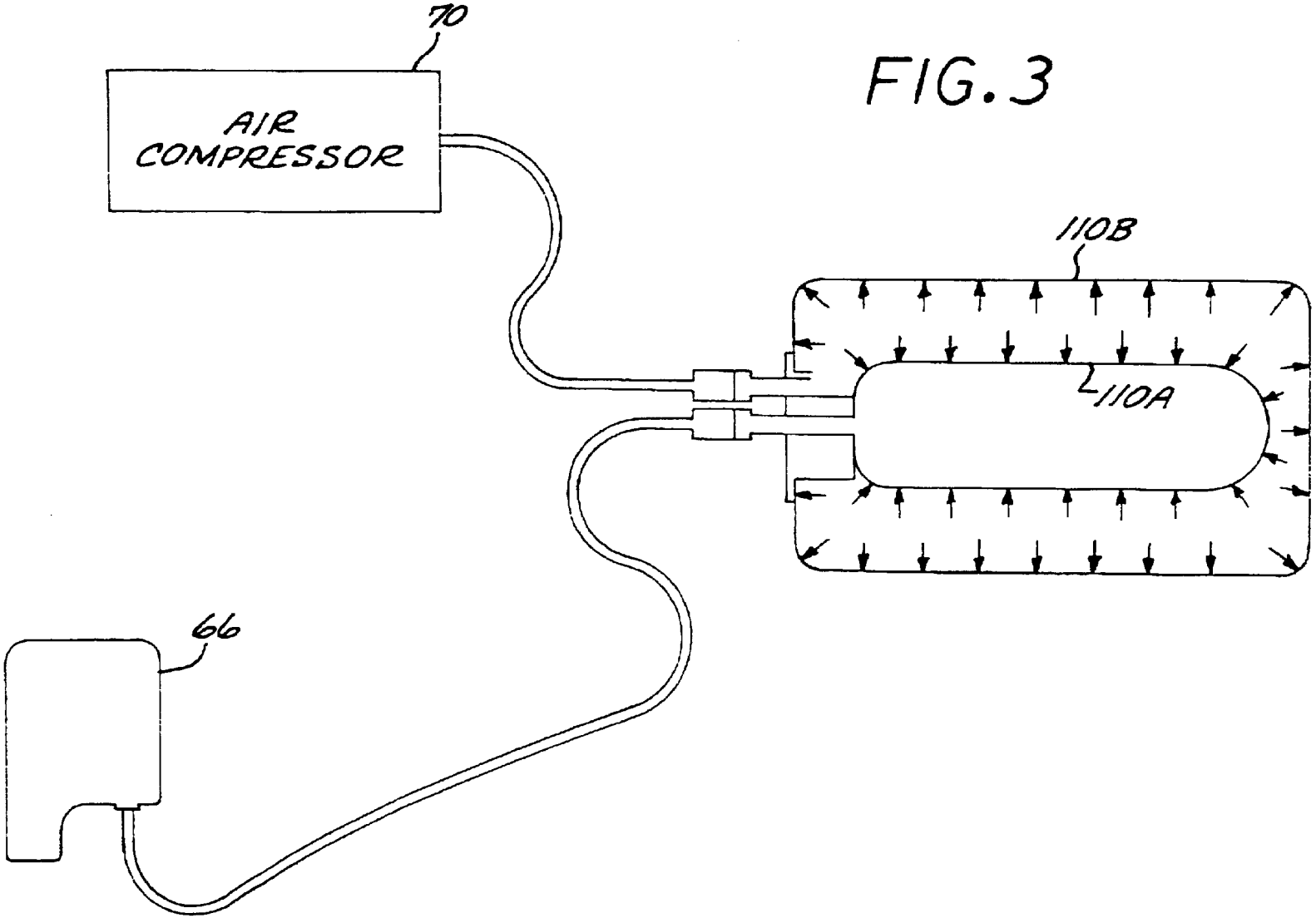
FIG. 3 is a schematic block diagram illustrating in a simplified manner the connection between an off-carriage ink container, an air pressure source, and an on-carriage print cartridge of the printer/plotter system of FIG. 1.

FIG. 3 is a simplified diagrammatic view illustrating the pressure source 70, the print cartridge 66, and the collapsible ink reservoir 110*a* and pressure chamber 110B. During idle periods, the pressure chamber 110B (which is defined by a pressure vessel, as more particularly described herein) is allowed to de-pressurize. Also, the ink containers 110–116 are not pressurized during shipment.

Figure 4:
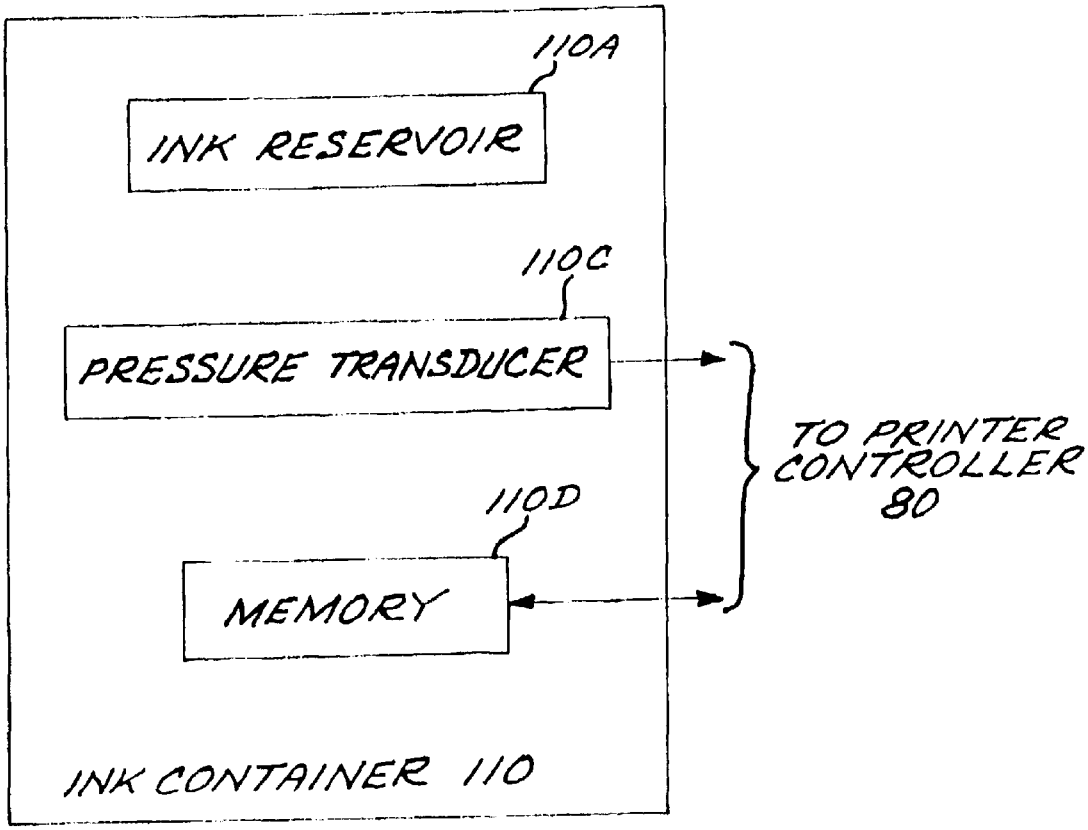
FIG. 4 is a schematic block diagram depicting major components of one of the ink containers of the printer/plotter system of FIG. 1.

By way of illustrative example, each of the ink containers includes an ink reservoir, an integral ink cartridge memory, and a low ink level sensing pressure transducer disposed in the container in accordance with the invention, as schematically depicted in FIG. 4 for the representative example of the ink container 110 that more particularly includes an ink reservoir 110A, an integral ink cartridge memory 110D, and a low ink level sensing pressure transducer 110C located in the container 110.

Continuing to refer to FIG. 1, the scanning print carriage 52, the print cartridges 60–66, and the ink containers 110–114 are electrically interconnected to a printer microprocessor controller 80 that includes printer electronics and firmware for the control of various printer functions, including for example analog-to-digital converter circuitry for converting the outputs of the low ink level sensing pressure transducers of the ink containers 110–116. The controller 80 thus controls the scan carriage drive system and the printheads on the print carriage to selectively energize the printheads, to cause ink droplets to be ejected in a controlled fashion on the print medium 40. The printer controller 80 further detects a low level of remaining ink volume in each of the ink containers 110–114 pursuant to the output of a pressure transducer employed in each of the ink containers in accordance with the invention.

A host processor 82, which includes a CPU 82A and a software printer driver 82B, is connected to the printer controller 82. For example, the host processor 82 comprises a personal computer that is external to the printer 50. A monitor 84 is connected to the host processor 82 and is used to display various messages that are indicative of the state of the ink jet printer. Alternatively, the printer can be configured for stand-alone or networked operation wherein messages are displayed on a front panel of the printer.

Figure 5:
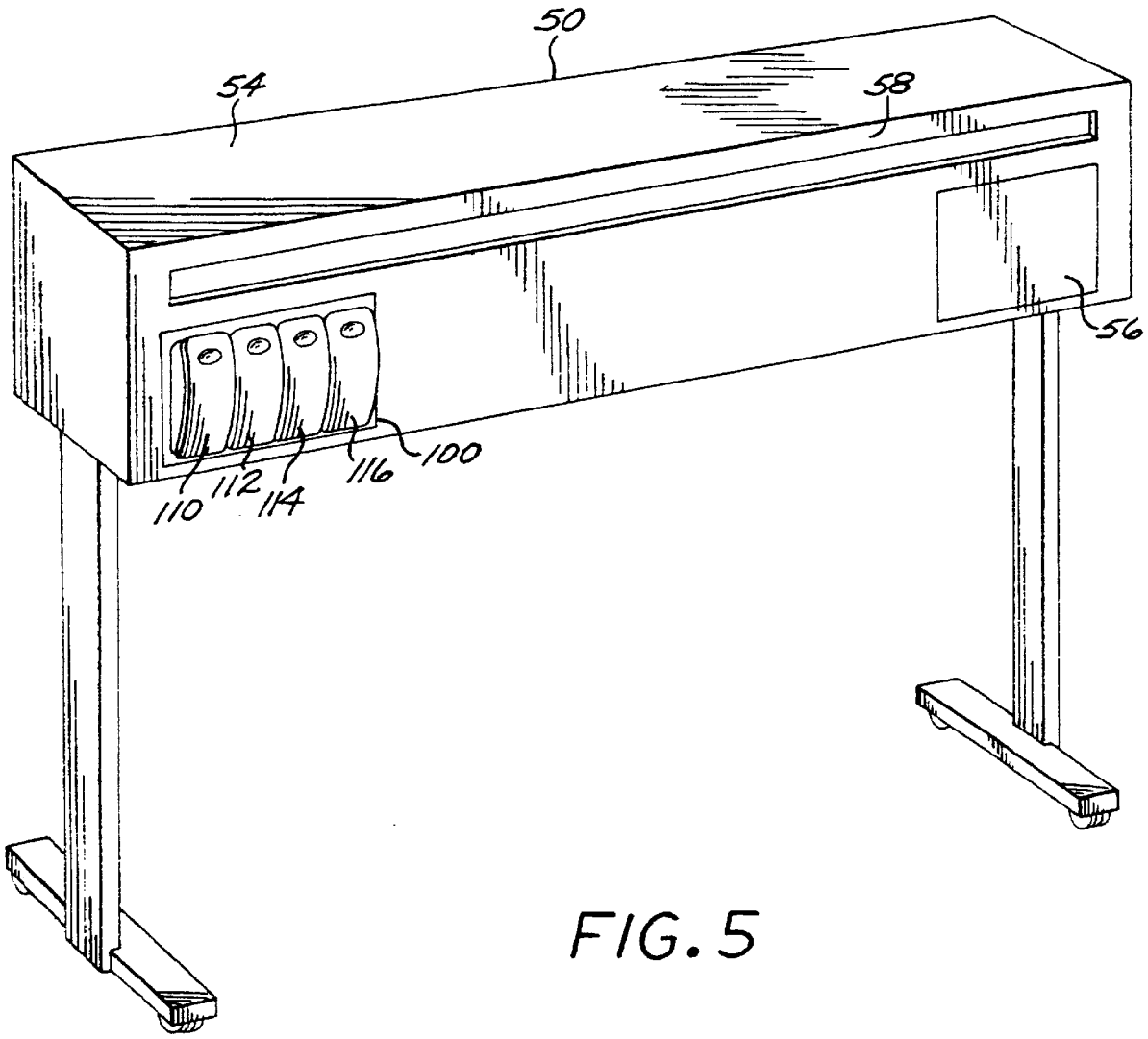
FIG. 5 a simplified isometric view of an implementation of the printer/plotter system of FIG. 1.

FIG. 5 shows in isometric view an exemplary form of a large format printer/plotter in which the invention can be employed, wherein four off-carriage (or off-axis) ink containers 110, 112, 114, 116 are shown installed in an ink supply station. The printer/plotter of FIG. 5 further includes a housing 54, a front control panel 56 which provides user control switches, and a media output slot 58. While this exemplary printer/plotter is fed from a media roll, it should be appreciated that alternative sheet feed mechanisms can also be used.

Referring now to FIGS. 6–14, schematically illustrated therein is a specific implementation of an ink container 200 which employs a low ink level sense apparatus that is comprised of a pressure transducer contained in the ink container, and which can be implemented as each of the ink containers 110–116 which are structurally substantially identical.

Figure 6:
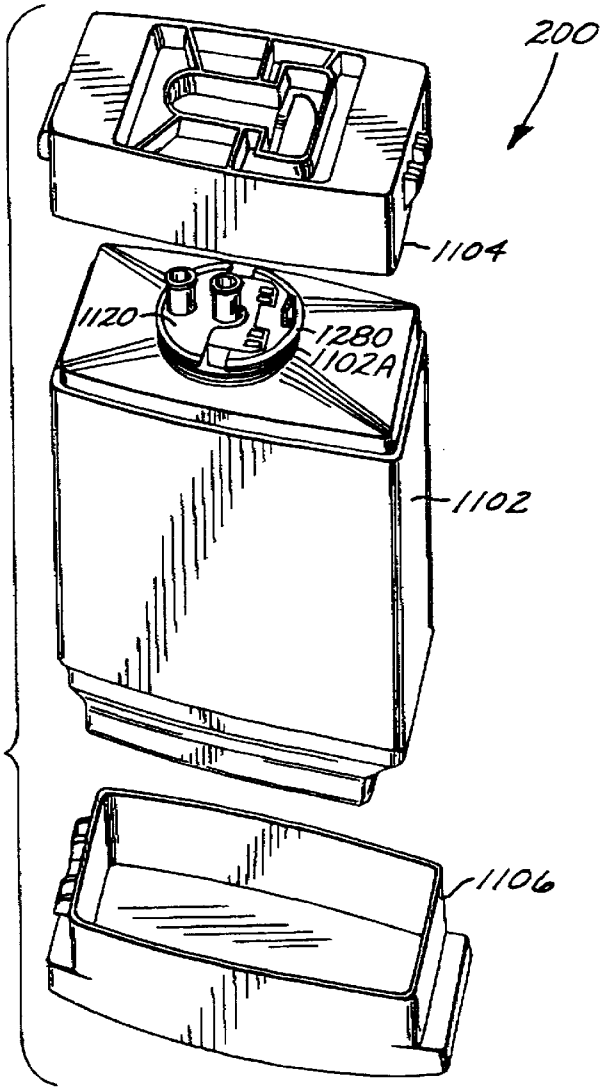
FIG. 6 is a schematic isometric exploded view illustrating the major components of an implementation of one of the ink containers of the printer/plotter system of FIG. 1 in which an ink level sensing pressure transducer in accordance with the invention can be employed.
Figure 7:
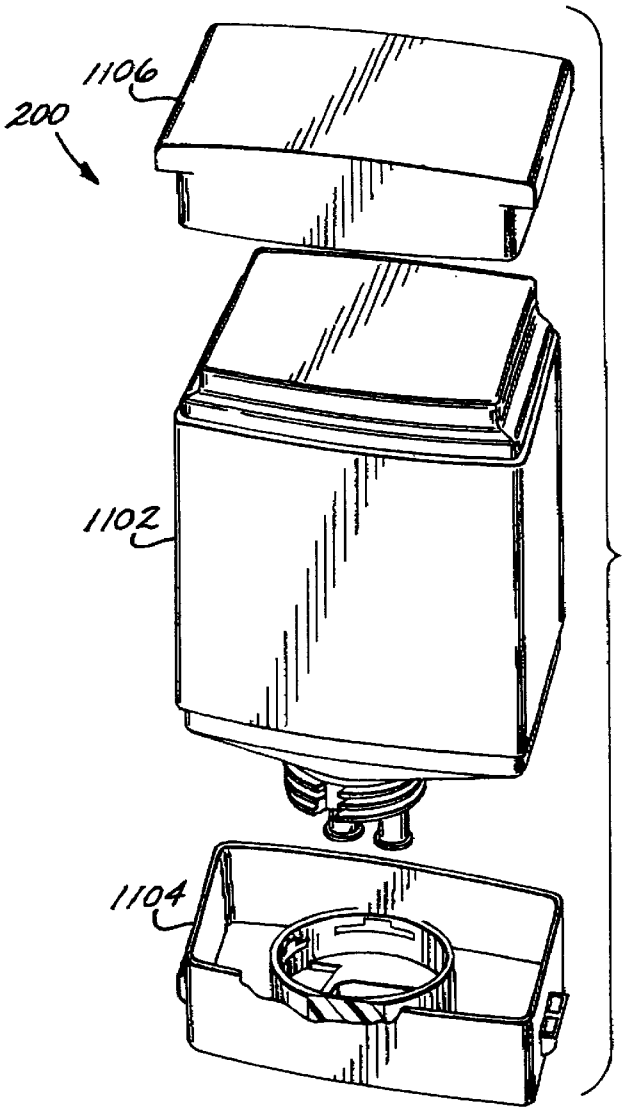
FIG. 7 is a further schematic isometric exploded view illustrating the major components of an implementation of one of the ink containers of the printer/plotter system of FIG. 1 in which an ink level sensing pressure transducer in accordance with the invention can be employed.

As shown in FIGS. 6–7, the ink container 200 generally includes an outer container or pressure vessel 1102, a chassis member 1120 attached to a neck region 1102A at a leading end of the pressure vessel 1102, a leading end cap 1104 attached to the leading end of the pressure vessel, and a trailing end cap 1106 attached to the trailing end of the pressure vessel 1102.

Figure 8:
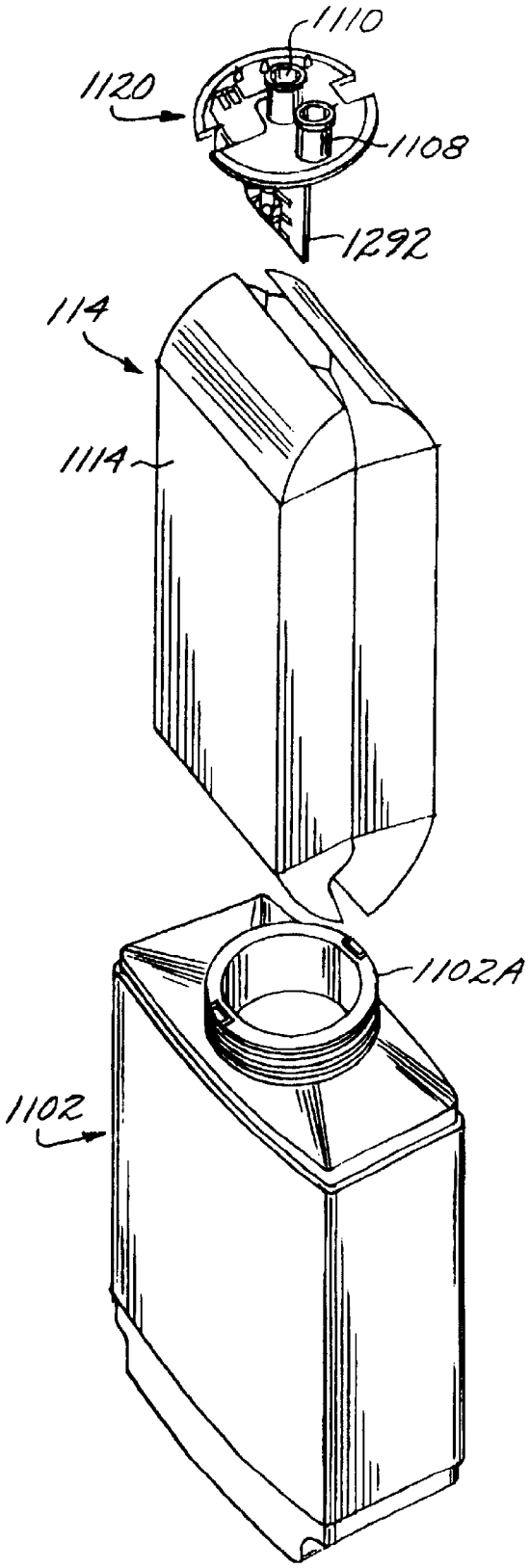
FIG. 8 is an exploded isometric view showing the pressure vessel, collapsible ink reservoir, and chassis member of the ink container of FIGS. 6 and 7.
Figure 9:
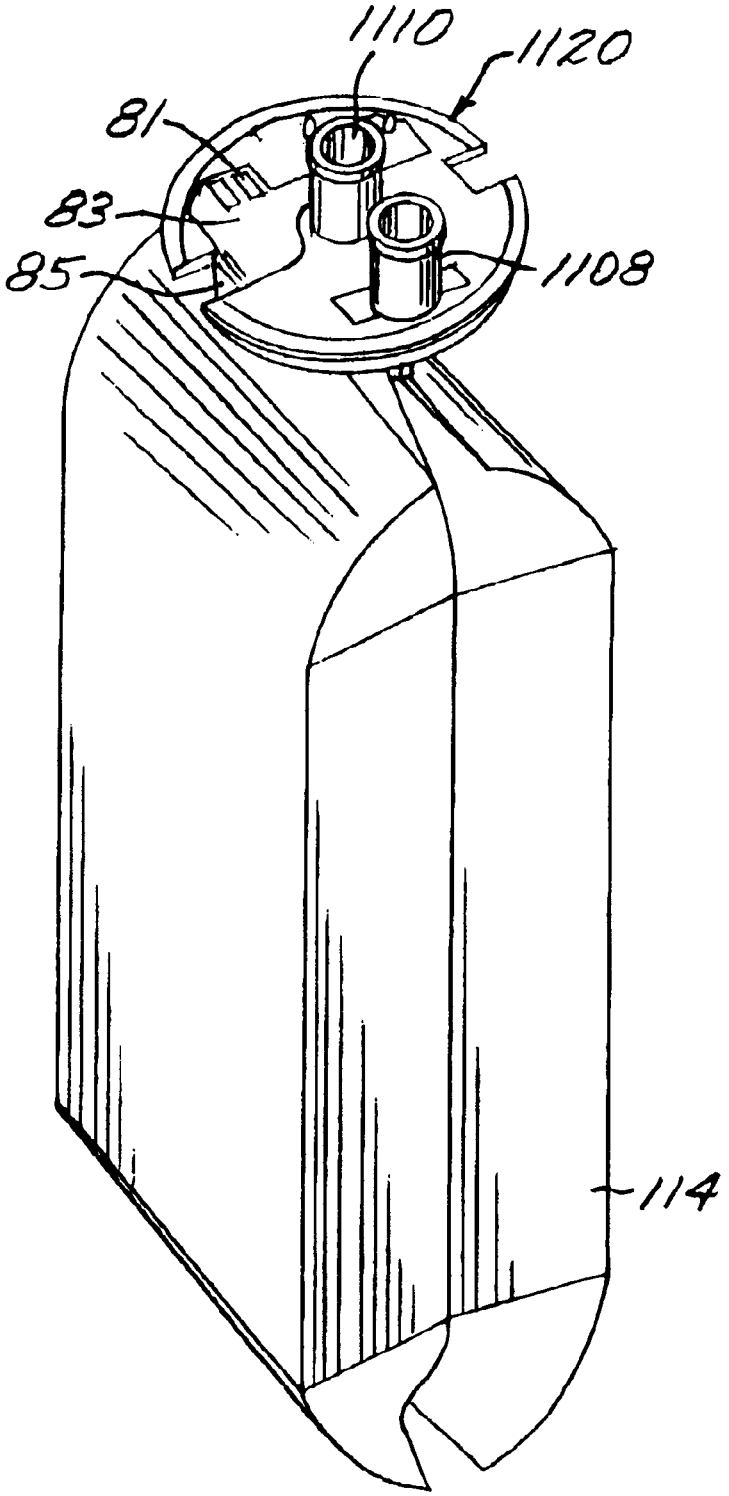
FIG. 9 is a schematic isometric view illustrating the collapsible ink reservoir and chassis member of the ink container of FIGS. 6 and 7.
Figure 10:
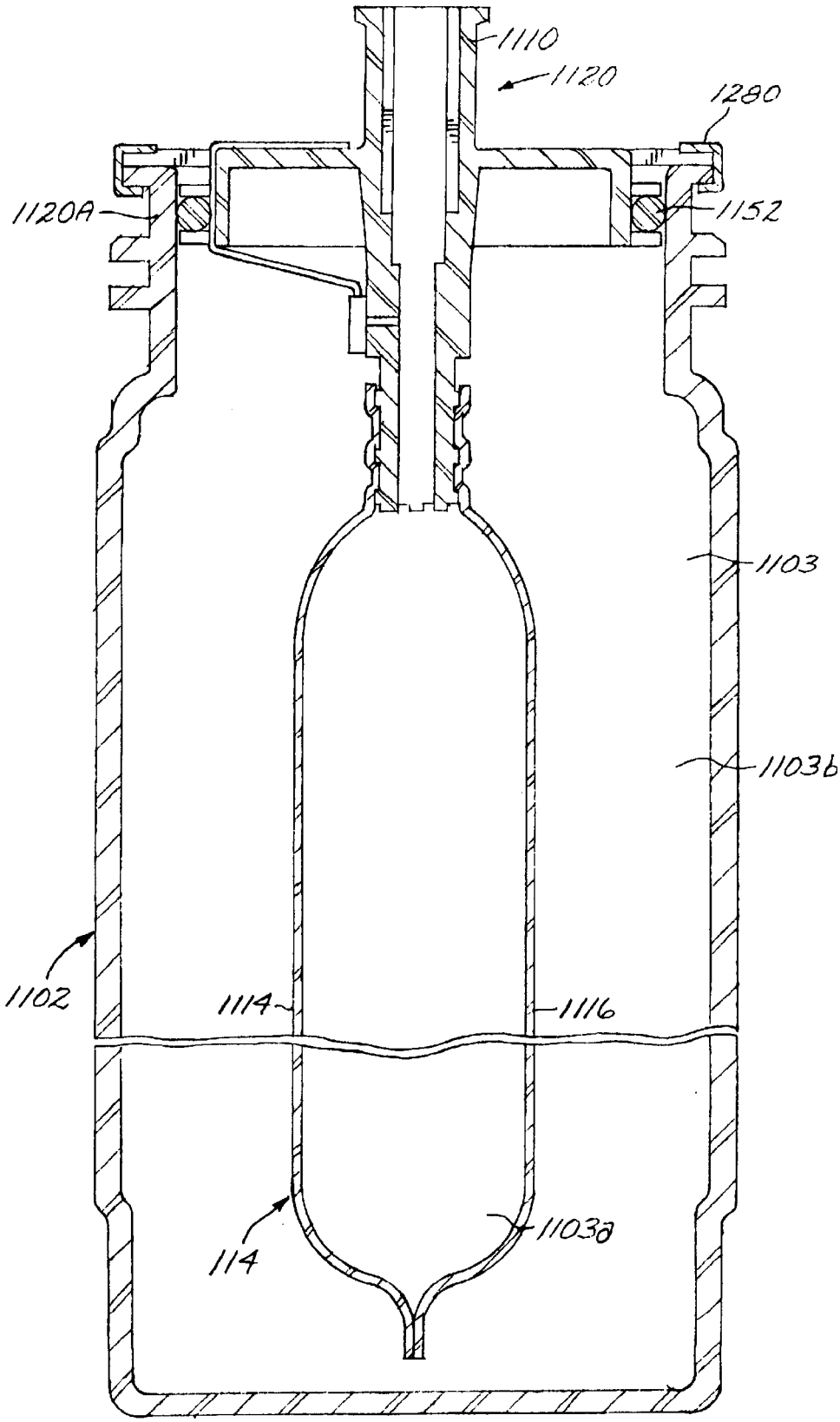
FIG. 10 is a cross-sectional view of a pressure transducer disposed in the ink container of FIGS. 6 and 7.
Figure 11:
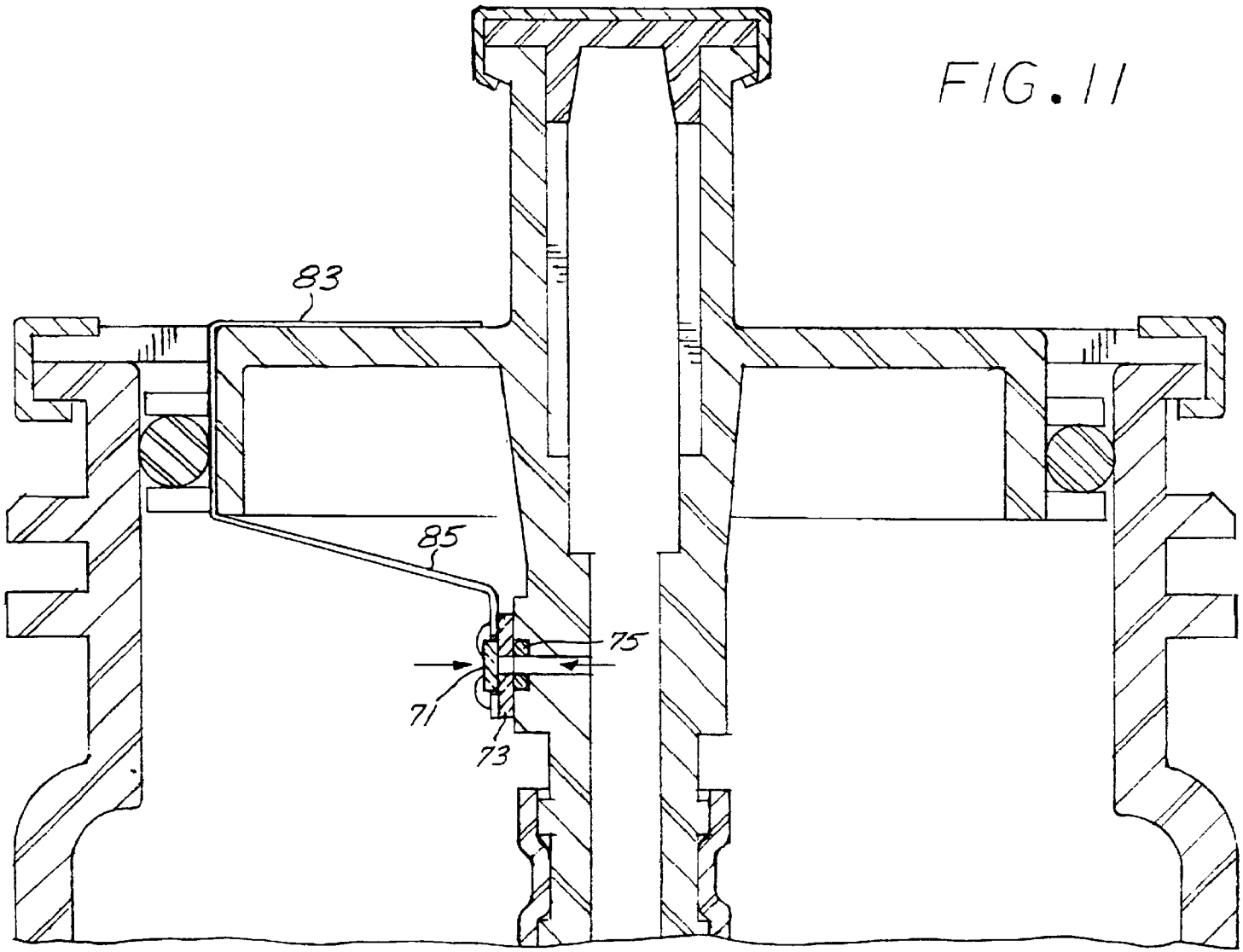
FIG. 11 is a cross sectional view illustrating the attachment of the pressure transducer to the chassis member of the ink container of FIGS. 6 and 7.
Figure 12:
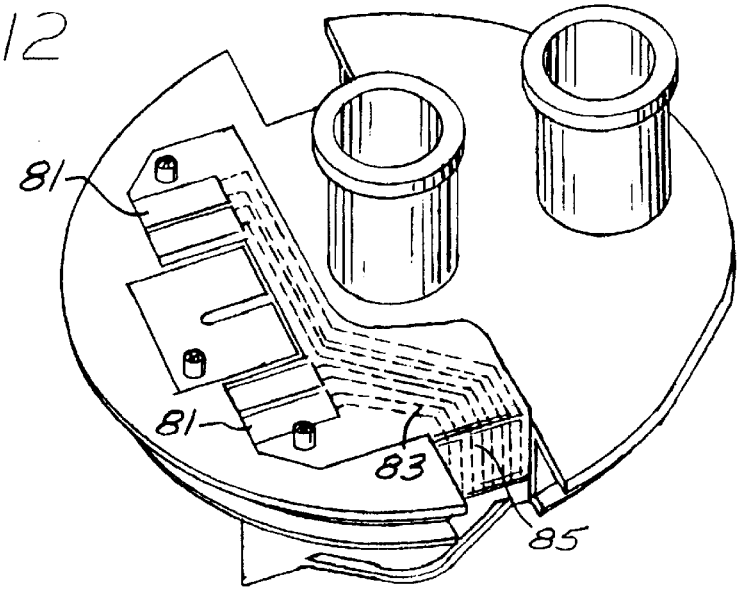
FIG. 12 is an isometric view illustrating electrical contacts disposed on the top portion of the chassis member of the ink container of FIGS. 6 and 7.
Figure 13:
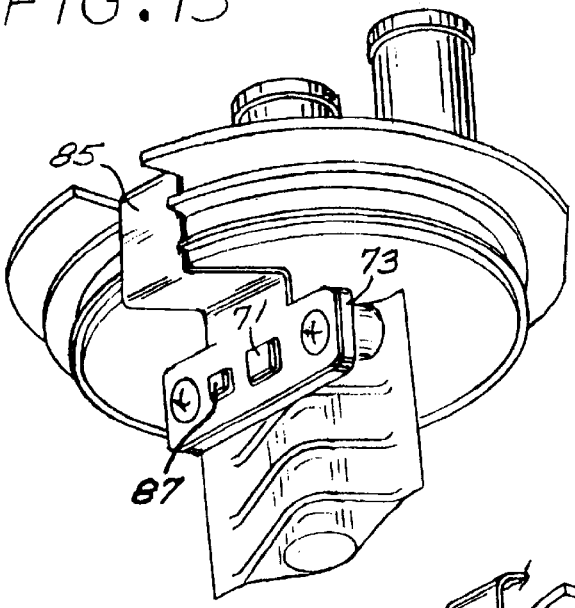
FIG. 13 is an isometric view illustrating the attachment of the pressure transducer to the chassis member of the ink container of FIGS. 6 and 7.
Figure 14:
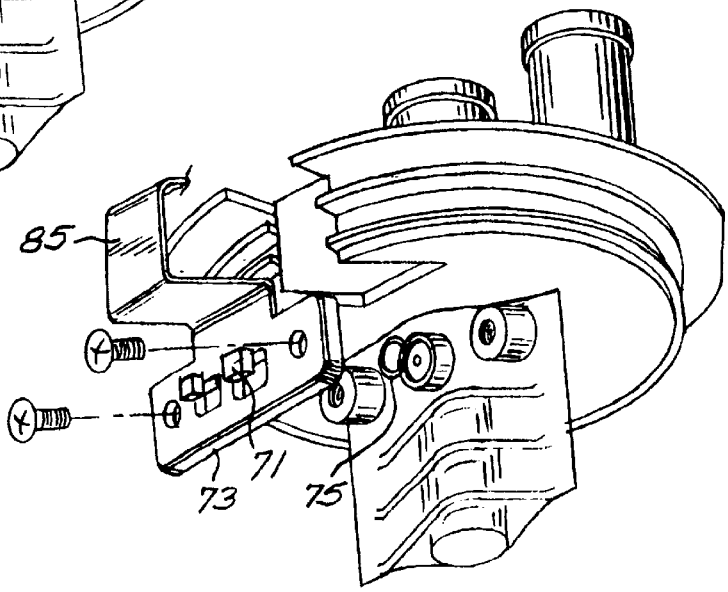
FIG. 14 is an exploded view illustrating the pressure transducer and the chassis member of the ink container of FIGS. 6 and 7.

As more particularly shown in FIGS. 8–10, the ink container 200 further includes a collapsible ink bag or reservoir 114 disposed in an interior chamber 1103 defined by the pressure vessel 1102 and sealingly attached to a keel portion 1292 of the chassis 1120 which seals the interior of the pressure vessel 1102 from outside atmosphere while providing for an air inlet 1108 to the interior of the pressure vessel 1102, and an ink outlet port 1110 for ink contained in the ink reservoir 114.

The chassis 1120 is secured to the opening of the neck region 1102A of the pressure vessel 1102, for example by an annular crimp ring 1280 that engages a top flange of the pressure vessel and an abutting flange of the chassis member. A pressure sealing O-ring 1152 suitably captured in a circumferential groove on the chassis 1120 engages the inside surface of the neck region 1102A of the pressure vessel 1102.

The collapsible ink reservoir 114 more particularly comprises a pleated bag having opposing walls or sides 1114, 1116. In an exemplary construction, an elongated sheet of bag material is folded such that opposed lateral edges of the sheet overlap or are brought together, forming an elongated cylinder. The lateral edges are sealed together, and pleats are in the resulting structure generally in alignment with the seal of the lateral edges. The bottom or non-feed end of the bag is formed by heat sealing the pleated structure along a seam transverse to the seal of the lateral edges. The top or feed end of the ink reservoir is formed similarly while leaving an opening for the bag to be sealingly attached to the keel portion 1292 of the chassis 1120. By way of specific example, the ink reservoir bag is sealingly attached to keel portion 1292 by heat staking.

The collapsible ink reservoir 114 thus defines an occupied portion 1103*a* of the interior chamber 1103, such that an unoccupied portion 1103*b* of the interior chamber 1103 is formed between the pressure vessel 1102 and the collapsible ink reservoir 114. The air inlet 1108 is the only flow path into or out of the unoccupied portion 1103*b* which functions as an air pressure chamber, and more particularly comprises a fluid conveying conduit that is in communication with the unoccupied portion 1103*b* of the interior chamber 1103. The ink outlet port 1110 is the only flow path into or out of the occupied portion 1103*a* and comprises a fluid conveying conduit that is in communication with the occupied portion 1103*a* of the interior chamber 1103, namely the interior of the collapsible ink reservoir 114. The ink outlet port 1110 is conveniently integrated with the keel portion 1292 of the chassis 1120.

As more particularly shown in FIGS. 11–14, a pressure transducer 71 is disposed in the interior chamber 1103 so as to detect a difference between a pressure of the unoccupied portion 1103*b* of the interior chamber 1103 and a pressure of ink in the collapsible ink reservoir (i.e., a differential pressure), or a pressure of ink in the collapsible ink reservoir. By way of illustrative example, the pressure transducer 71 is mounted on a ceramic substrate 73 to form a transducer subassembly that is attached to an outside wall of the output port 1110. A bore or opening in the wall of the output port 1110 and a bore or opening in the substrate 73 expose the pressure transducer to pressure in the output port 1110. Appropriate sealing including an O-ring 75 is provided to prevent leakage between the interior of the outlet port 1110 and the unoccupied portion 1103*b* of the interior chamber 1103.

The electrical output of the pressure transducer 71 is provided to externally accessible contact pads 81 disposed on the top of the chassis 1120 via conductive leads 83 of a flexible printed circuit substrate 85 that extends between the ceramic substrate 73 and the top of the chassis 1120, passing on the outside surface of the chassis 1120 between the O-ring 1152 and such outside surface. The conductive leads 83 are electrically connected to the externally accessible contact pads 81 disposed on the top of the chassis which can be formed on one end of the flexible printed circuit substrate 85 that would be attached to the top of the chassis 1120. The output of the pressure transducer 71 can be sampled while printing which avoids the need to interrupt printing to take a reading.

Optionally, a memory chip package 87 can be conveniently mounted on the ceramic substrate 87 and interconnected to associated externally accessible contact pads by associated conductive leads 83 of the flexible printed circuit substrate 85.

By way of illustrative example, the pressure transducer 71 comprises a differential pressure transducer that is exposed to pressure in the ink outlet port 1110 and pressure in the unoccupied portion 1103*b* of the interior chamber 1103, and provides an output signal that is indicative of the difference between the air pressure in the unoccupied portion of the interior chamber 1103 and the pressure in the ink outlet port 1110. The pressure transducer 71 is very close to the ink supply in the collapsible ink reservoir 114 so as to avoid dynamic losses between the ink supply and the point of pressure measurement, and thus the pressure transducer 71 is effectively exposed to the ink supply pressure in the ink reservoir.

In use, the ink supply pressure in the ink reservoir 114 remains approximately equal to the pressure in the unoccupied portion 1103*b* of the interior chamber 1103 for much of the ink supply life, and thus the differential pressure is approximately zero for much of the ink supply life. As the ink supply approaches an empty condition, pressure in the ink reservoir 114 begins to decrease with decreasing remaining ink, whereby the differential pressure increases with decreasing ink. The relationship between differential pressure and the amount of ink remaining is reasonably consistent for any given system and can be reliably characterized. Thus, differential pressure information is utilized to reliably determine a close to empty condition that is used to provide a warning to the user or to cease printing.

As another example, the pressure transducer 71 comprises an absolute pressure transducer that is exposed only to the pressure in the collapsible ink reservoir, and provides an output signal that is indicative of the absolute pressure in the collapsible ink reservoir 114. An absolute pressure transducer can be employed for example wherein the pressure in the unoccupied portion 1103*b* is maintained at a known constant pressure, so that the output of the absolute pressure sensor can be compared with a constant pressure reference signal.

As a further example, the pressure transducer 71 comprises a pressure switch that provides an output when a sensed differential pressure exceeds a predetermined level, or when a sensed absolute pressure goes below a predetermined level. Such output can be utilized, for example, to generate a warning for the user that only a certain amount of ink is available for printing, or to cease printing.

While the foregoing implementation applies greater than ambient pressure to the ink supply, the invention can be employed in systems wherein the ink supply is subjected only to ambient or atmospheric pressure instead of a pressure that is greater than atmospheric pressure, for example in a system wherein a non-pressurized ink supply is elevated so that ink flows out of the ink container by gravity. Also, the disclosed invention can be employed in other printing or marking systems that employ liquid ink such as liquid electrophotographic printing systems.

Although the foregoing has been a description and illustration of specific embodiments of the invention, various modifications and changes thereto can be made by persons skilled in the art without departing from the scope and spirit of the invention as defined by the following claims.

What is claimed is:

1. An ink container comprising:

a container for containing a supply of ink and pressurizing gas;

an inlet into said container for receiving said pressurizing gas, whereby said supply of ink is pressurized by said pressurizing gas;

an outlet for supplying pressurized ink to an ink jet printhead; and a pressure transducer disposed within said container for providing an output signal indicative of an amount of said supply of ink remaining in said container.

2. The ink container of claim 1 wherein said pressure transducer is configured to sense a difference between a pressure of said pressurizing gas and a pressure of said ink supply.

3. The ink container of claim 1 wherein said pressure transducer is configured to sense an absolute of a pressure of said ink supply.

4. The ink container of claim 1 wherein said outlet includes a conduit in said container and wherein said pressure transducer is configured to sense a pressure of ink in said conduit.

5. The ink container of claim 1 wherein said outlet includes a conduit in said container and wherein said pressure transducer is disposed on an outside of a wall of said conduit.

6. The ink container of claim 1 wherein said container includes an outer container defining an interior chamber and an ink reservoir disposed within said interior chamber, said outer container and said reservoir defining a portion of said interior chamber that is external of said ink reservoir.

7. The ink container of claim 6 wherein said pressure transducer is disposed in said portion of said interior chamber that is external of said ink reservoir.

8. The ink container of claim 6 wherein said outlet is in communication with an interior of said ink reservoir, and wherein said inlet is in communication with said portion of said interior chamber that is external of said ink reservoir.

9. The ink container of claim 1 further including a memory element.

10. An ink container comprising:

a container defining an interior chamber and configured to hold a supply of ink that defines an occupied portion and an unoccupied portion of said interior chamber; and a pressure sensor disposed in said container for providing an output signal indicative of an amount of said supply of ink remaining in said container.

11. The ink container of claim 10 wherein said pressure sensor is adapted to sense a difference between a pressure of said supply of ink and a pressure in said unoccupied portion.

12. The ink container of claim 10 wherein said pressure sensor is adapted to sense an absolute pressure of said supply of ink.

13. The ink container of claim 10 wherein said pressure sensor is disposed in said unoccupied portion of said interior chamber.

14. The ink container of claim 10 wherein said unoccupied portion is exposed to atmospheric pressure.

15. The ink container of claim 14 wherein said container comprises an outer container and a collapsible bag disposed within said pressure vessel.

16. The ink container of claim 10 wherein said unoccupied portion is configured to contain pressurizing gas for pressurizing said supply of ink.

17. The ink container of claim 16 wherein said container comprises a pressure vessel and a collapsible bag disposed within said pressure vessel.

18. The ink container of claim 10 further including a memory element.

19. An ink container comprising:

a collapsible ink reservoir for containing a supply of ink;

an outer container enclosing said collapsible ink reservoir and configured to receive a pressurizing gas that pressurizes said supply of ink; and a pressure transducer disposed in said outer container for providing an output signal indicative of an amount of said supply of ink remaining in said collapsible ink reservoir.

20. The ink container of claim 19 wherein said pressure transducer is configured to sense a difference between a pressure of said pressurizing gas and a pressure of said ink supply.

21. The ink container of claim 19 wherein said pressure transducer is configured to sense an absolute of a pressure of said ink supply.

22. The ink container of claim 19 further including an outlet conduit in said outer container and fluidically coupled to said collapsible ink reservoir, and wherein said pressure transducer is configured to sense a pressure of ink in said conduit.

23. The ink container of claim 19 further including an outlet conduit in said container and fluidically coupled to said collapsible ink reservoir, and wherein said pressure transducer is disposed on an outside of a wall of said conduit.

24. The ink container of claim 19 wherein said pressure transducer is disposed externally of said ink reservoir.

25. The ink container of claim 19 further including a memory element disposed in said container.

26. An ink container comprising:

containing means for containing a supply of ink; and pressure sensing means disposed within said containing means for providing an output signal indicative of an amount of said supply of ink remaining means.

27. The ink container of claim 26 further including a memory element.

* * * * *

UNITED STATES PATENT AND TRADEMARK OFFICE

CERTIFICATE OF CORRECTION

PATENT NO. : 6,435,638 B1
DATED : August 20, 2002
INVENTOR(S) : Wilson et al.

It is certified that error appears in the above-identified patent and that said Letters Patent is hereby corrected as shown below:

Column 8,
Line 23, after "reminaing", insert -- in said containing --.

Signed and Sealed this

Third Day of February, 2004

JAMES E. ROGAN
*Director of the United States Patent and Trademark Office*